US005687492A

United States Patent [19]

Muraoka

[11] Patent Number: 5,687,492

[45] Date of Patent: Nov. 18, 1997

[54] SANDAL

[75] Inventor: Tsutomu Muraoka, Sakai, Japan

[73] Assignee: Shimano, Inc., Osaka, Japan

[21] Appl. No.: 665,420

[22] Filed: Jun. 18, 1996

[30] Foreign Application Priority Data

Jun. 23, 1995 [JP] Japan ..... 7-181060

[51] Int. Cl.[6] ..... A43B 5/14; A43B 3/12

[52] U.S. Cl. ..... 36/131; 36/11.5

[58] Field of Search ..... 36/11.5, 131, 7.6, 36/127

[56] References Cited

U.S. PATENT DOCUMENTS

| | | | |
|---|---|---|---|
| 2,807,098 | 9/1957 | Wunker | 36/7.6 |
| 2,894,338 | 7/1959 | Scholl | 36/8.5 |
| 2,932,911 | 4/1960 | Musebeck | 36/8.5 |
| 3,323,233 | 6/1967 | Scholl | 36/11.5 |
| 4,377,952 | 3/1983 | Gamondes | 74/594.6 |
| 4,793,075 | 12/1988 | Thatcher | 36/11.5 |
| 4,893,420 | 1/1990 | Bezin | 36/131 |
| 5,131,291 | 7/1992 | Beyl | 74/594.6 |
| 5,205,056 | 4/1993 | Okajima et al. | 36/131 |
| 5,438,767 | 8/1995 | Stein | 36/11.5 |
| 5,465,506 | 11/1995 | Matis et al. | 36/11.5 |
| 5,473,963 | 12/1995 | Aeschbach | 36/131 X |
| 5,561,919 | 10/1996 | Gill | 36/11.5 |

FOREIGN PATENT DOCUMENTS

| | | | |
|---|---|---|---|
| 0 298 139 | 1/1989 | European Pat. Off. . | |
| 0 553 934 A1 | 8/1993 | European Pat. Off. . | |
| 2350803 | 12/1977 | France . | |
| 2464660 | 3/1981 | France . | |
| 2620002 | 3/1989 | France . | |
| 2240102 | 2/1974 | Germany . | |
| 3825089 A1 | 1/1990 | Germany . | |
| 3175 | 7/1884 | United Kingdom | 36/7.6 |

OTHER PUBLICATIONS

Nike fall 1995 footwear, pp. 131–132, Nov. 1994.

European Search Report for EP 96 30 4607, dated Jan. 13, 1997.

European Search report for EP 96 30 4607, dated Oct. 9, 1996.

*Primary Examiner*—Ted Kavanaugh

*Attorney, Agent, or Firm*—James A. Deland

[57] ABSTRACT

A sandal comprises a sole and a strap connected to the sole for securing the sandal to the foot The sole includes a cleat attachment hole for fixing a cleat on a bottom surface thereof. The sole includes a middle sole and a covering sole disposed on a lower surface of the middle sole. The coveting sole includes a window for exposing a portion of the middle sole, and at least two cleat attachment holes are disposed in the window for fixing a cleat to a bottom surface of the sole so that the cleat does not extend below the lowermost surface of the sole.

28 Claims, 5 Drawing Sheets

SANDAL

BACKGROUND OF THE INVENTION

The present invention is directed to cycling footwear and, more specifically, to a sandal that can be used for walking and to which a cleat may be mounted for cycling with cleat-fixing pedals.

Many advancements have been made bicycle technology, including cycling footwear. For example, many refinements have been made to cycling footwear to lower pedaling energy losses. This is accomplished in part by using a rigid sole so that energy is not lost through flexure of the sole. Energy loss also is minimized by securing the footwear snugly to the foot. See, for example, Japanese Laid-Open Patent Application 3-254702. Although it is very desirable to avoid energy loss, it is also desirable to have footwear that is comfortable to use over long periods of time so that the cyclist does not feel discomfort during a long trip. Such comfort must also be available when the cyclist is using the cycling shoe for ordinary walking. However, some cycling shoes cause the feet to sweat in summer when the shoes are worn for a long time. This can be somewhat uncomfortable.

SUMMARY OF THE INVENTION

The present invention is directed to cycling footwear, and more specifically to a sandal that can be worn comfortably in hot weather and can be used for both cycling and regular walking. In one embodiment of the present invention, a sandal comprises a sole and a strap connected to the sole for securing the sandal to the foot, wherein the sole includes a cleat attachment hole for fixing a cleat on a bottom surface thereof. In a more specific embodiment, the sole includes a relatively rigid middle sole and a covering sole disposed on a lower surface of the middle sole. The middle sole provides rigidity to minimize energy loss during cycling. The covering sole includes a window for exposing a portion of the middle sole, and at least two cleat attachment holes are disposed in the window for fixing a cleat to a bottom surface of the sole. Preferably, the cleat does not extend below the lowermost surface of the sole. Thus, the sandal may be used effectively for cycling without interfering with normal walking.

DETAILED DESCRIPTION OF THE EMBODIMENTS

Figure 1:
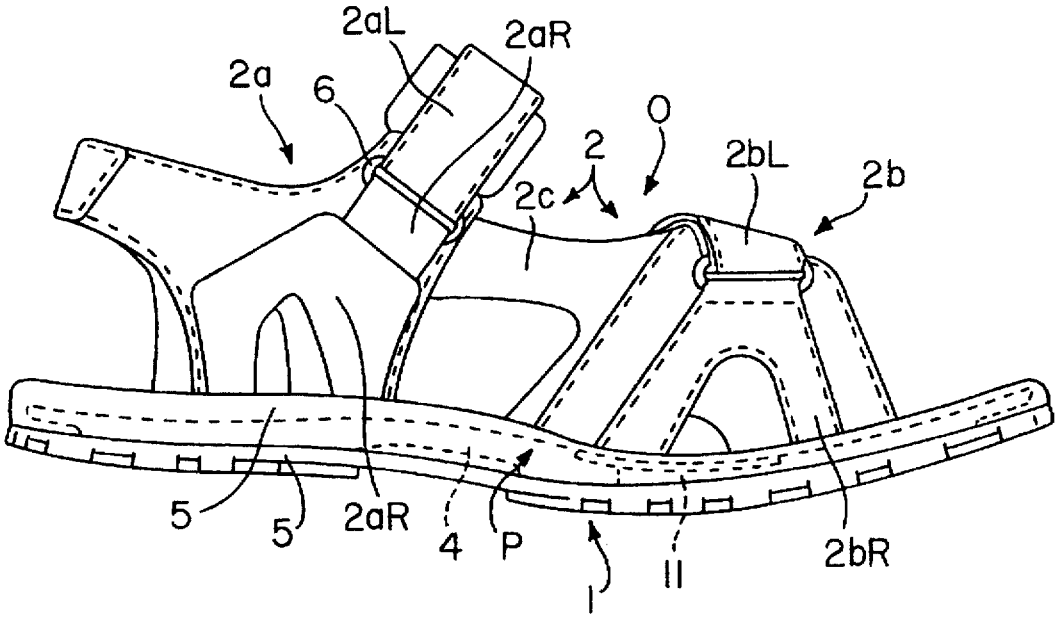
FIG. 1 is a right side view of a particular embodiment of a sandal according to the present invention.
Figure 2:
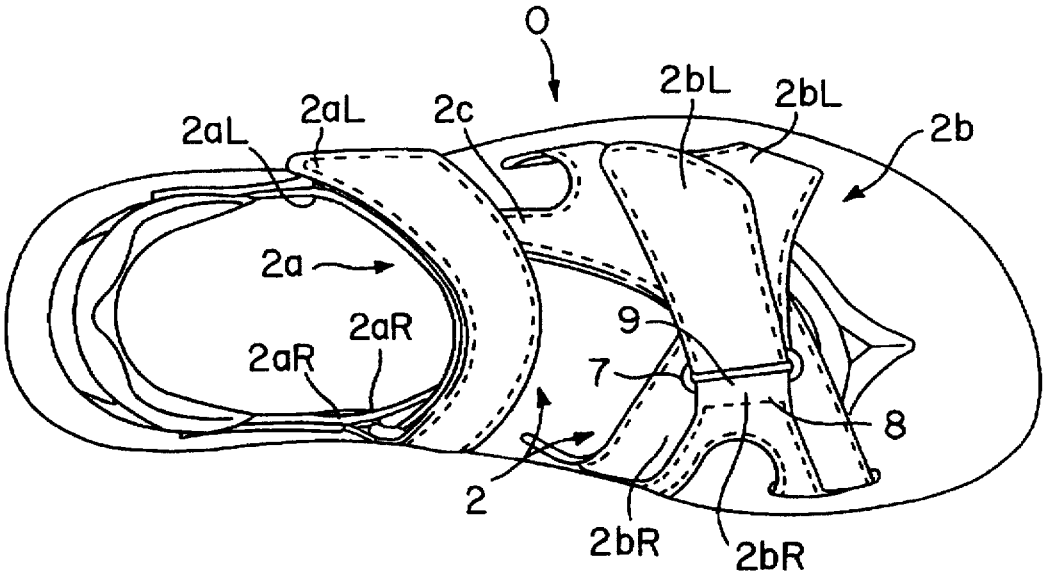
FIG. 2 is a top view of the sandal shown in FIG. 1.
Figure 3:
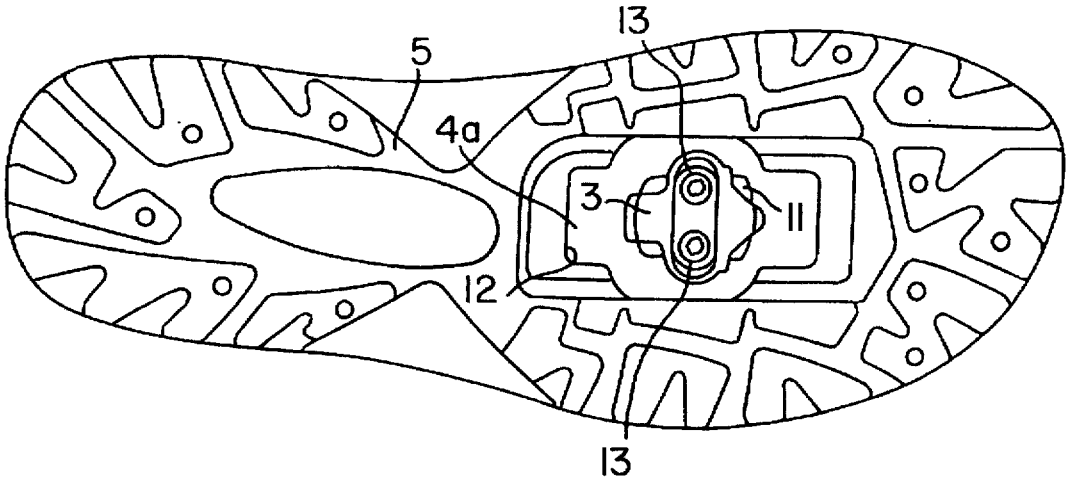
FIG. 3 is a bottom view of the sandal shown in FIG. 1.

FIG. 1 is a fight side view of a particular embodiment of a sandal according to the present invention. FIG. 2 is a top view of the sandal, and FIG. 3 is a bottom view of the sandal. A left sandal is shown in the figures, but the right sandal is merely a mirror image of the left sandal so a separate description of the right sandal will be omitted.

As shown in FIGS. 1–3, a sandal 0 comprises a sole 1 and a foot-securing band or strap 2 affixed to the sole 1 for securing sole 1 to the cyclist's foot. The bottom of the sole 1 has cleat attachment holes 11 for fitting in a cleat 3 (FIG. 3). The cleat attachment holes 11 are located in front of the sole center and are shaped as recessions in the sole surface. In this embodiment, the lower surface of cleat 3 does not extend below the ground-contacting surface of the sole 1. As a result, the wearer experiences no discomfort in the area of the foot sole during walking.

The sole 1 comprises a middle sole 4 and covering soles 5. Middle sole 4 is formed of a hard resin, metal, or some other material of comparatively poor elasticity. Covering soles 5 are joined to the upper and lower surfaces of the middle sole 4. Covering soles 5 provide an elastic cover for the middle sole 4 and are formed of hard rubber or a soft material with comparatively good flexibility.

The foot-supporting band 2 comprises a heel-securing band **2*a*, a toe-securing band 2*b*, and a connecting band 2*c*. Heel-securing band 2*a* is a back strap for securing the heel area of the foot, toe-securing band 2*b* is a front strap for securing the toe area of the foot, and connecting band 2*c* connects the heel-securing band 2*a* and the toe-securing band 2*b* in the longitudinal direction of the foot. The heel-securing band 2*a* comprises a left heel-securing band 2*a*L and a right heel-securing band 2*a*R. The left end of the left heel-securing band 2*a*L is affixed to the sole 1, while the other end can be released. Similarly, the right end of the right heel-securing band 2*a*R is affixed to the sole 1, while the other end can be released. The toe-securing band 2*b* comprises a left toe-securing band 2*b*L and a right toe-securing band 2*b*R. The left end of the left toe-securing band 2*b*L is affixed to the sole 1, while the other end can be released. Similarly, the right end of the right toe-securing band 2*b*R is affixed to the sole 1, while the other end can be released. In the left sandal, the connecting band 2*c* connects the left heel-securing band 2*a*L and the left toe-securing band 2*b*L** in the longitudinal direction.

The heel-securing band **2*a* is provided with a heel-coupling means 6 for coupling the releasable side of the left heel-securing band 2*a*L and the releasable side of the right heel-securing band 2*a*R. In this embodiment, the heel-coupling means 6 may be a ring provided with a slit and affixed to the releasable end of the right heel-securing band 2*a*R by sewing or other means. Similarly, the toe-securing band 2*b* is provided with a toe-coupling means 7 for coupling the releasable side of the left toe-securing band 2*b*L and the releasable side of the right toe-securing band 2*b*R. In this embodiment, the toe-coupling means 7 may be a ring provided with a slit and affixed to the releasable end of the right toe-securing band 2*b*R by a stitch or other means 8. For example, the releasable end of the right toe-securing band 2*b*R can be folded back, and a looped stitched portion 9 can be formed by sewing. The ring 7 is passed through this stitched portion 9**.

The left heel-securing band **2*a*L rises from the left side of the sole 1 for the left sandal, passes through the heel-coupling means 6, and folds back. A hook-and-loop fastener (such as a Velcro® fastener) is affixed to the facing surfaces of the folding portion on the releasable side of the left heel-securing band 2aL. Similarly, the left toe-securing band 2bL rises from the left side of the sole 1 for the left sandal, passes through the toe-coupling means 7, and folds back. A hook-and-loop fastener (such as a Velcro® fastener) is affixed to the facing surfaces of the folding portion on the releasable side of the left toe-securing band 2**bL.

Figure 5:
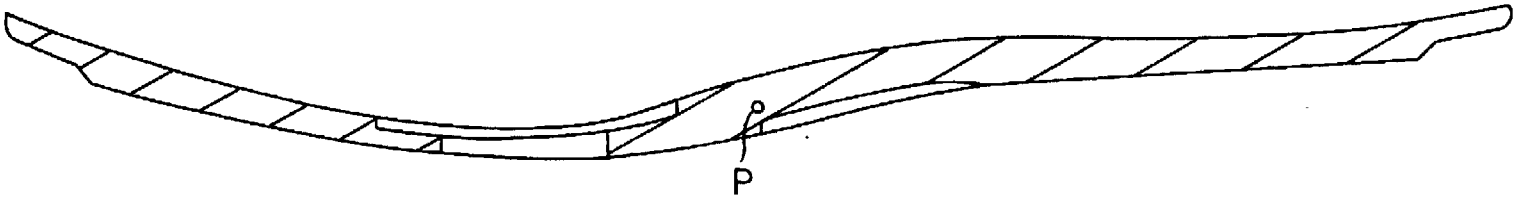
FIG. 5 is a cross sectional view of the middle sole taken along line V—V in FIG. 4.

As shown in FIGS. 1 and 5, the middle sole 4 is slightly curved downward in a convex fashion (with the exception of an area on the heel side). In this embodiment, the entire middle sole 4 is curved, having a point of inflection P. The curving forms a curved surface that follows the lower surface of the foot. Cleat attachment holes 11 for fitting in a cleat are formed at positions near the lower end point of this convex surface. As shown in FIG. 3, a window 12 is formed in the lower-side portion of the covering soles 5, and the lower surface of the middle sole 4 is exposed. The cleat attachment holes 11 are formed in the exposed portion 4a of the middle sole 4. The cleat 3 (whose upper-end surface is bonded under pressure to the lower-end surface) is movably and rotatably secured to the exposed portion 4a. The cleat 3 is affixed to the middle sole 4 with a plurality of hexagonal-head bolts 13 and with nuts (the latter are not shown) in a well known manner. The cleat 3 can be attached while allowed to move in the longitudinal direction with respect to the sole 1, and the angle with respect to the longitudinal direction can be varied somewhat. As noted above, in this embodiment the cleat 3 does not extend below the lowermost surface of the sole 1.

Figure 4:
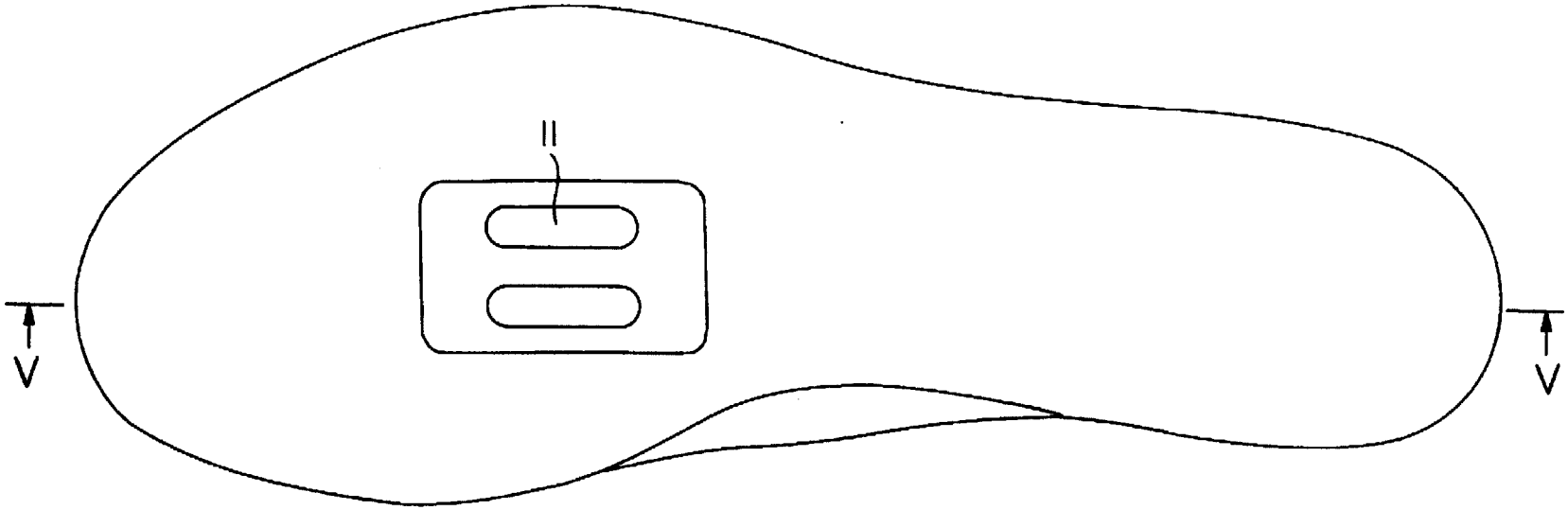
FIG. 4 is a top view of a particular embodiment of a middle sole used in the sandal shown in FIG. 1.

As shown in FIG. 4, the cleat attachment holes 11 are shaped as slits extending in the longitudinal direction of the footwear. The cleat attachment holes 11 may comprise two slits arranged in a row. Of course, the two cleat attachment holes 11 are not limited to slits and can be round holes, circular holes, or elliptical holes arranged in the form of islands in the longitudinal direction. The parts of the two cleat attachment bolts 13 that pass through the cleat attachment holes 11 are narrower (in the transverse direction that is orthogonal to the longitudinal direction) than the corresponding cleat attachment holes 11. The pitch of the row of two holes, that is, the distance between the centers of the two holes in the row in the transverse direction, is set at 14 mm. or less. In this embodiment, the distance between the front end of the sole and the central point in the longitudinal direction of the row of holes is set at 25 to 45 percent of the distance between the front and back ends of the sole, and the distance between the holes in the row is set at no more than 25 percent of the width of the sole in the vicinity of this row of holes. As a result, the surface area of the cleat attachment holes 11 is small, and the strength of the sole does not suffer. In addition, the pitch remains small when the cleat 3 is secured to the sole at an angle, thus making it possible to make the angle between the cleat 3 and the cleat attachment holes 11 relatively large even when only a small gap is formed between the cleat attachment bolts 13 and the cleat attachment holes 11. Adjusting the securing position by means of such a large attachment angle is convenient for the cyclist.

Figure 6:
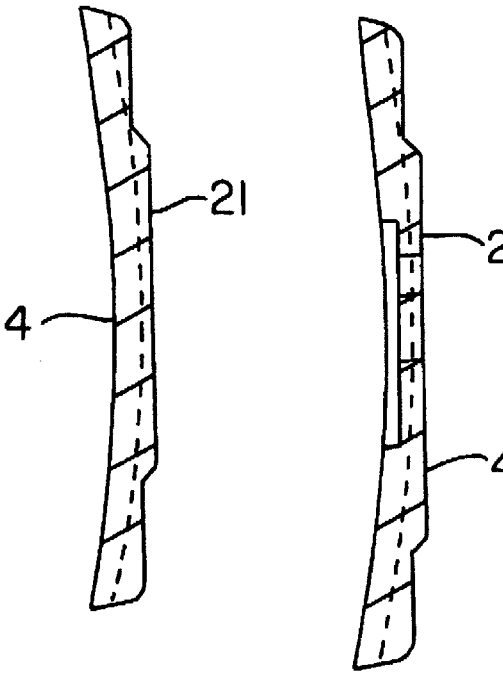
FIG. 6 is a cross sectional view of the middle sole taken along line VI—VI in FIG. 11.
Figure 7:
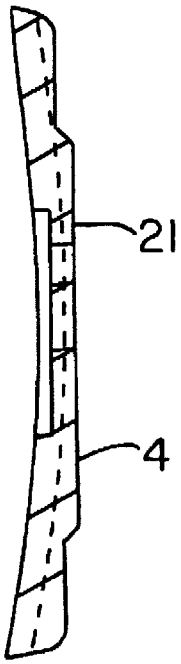
FIG. 7 is a cross sectional view of the middle sole taken along line VII—VII in FIG. 11.
Figure 8:
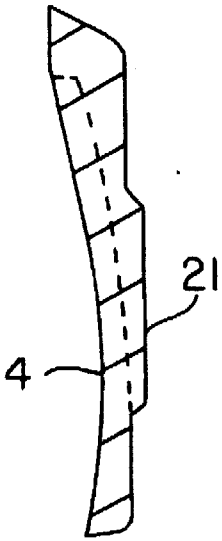
FIG. 8 is a cross sectional view of the middle sole taken along line VIII—VIII in FIG. 11.
Figure 9:
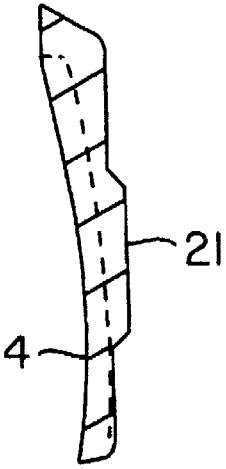
FIG. 9 is a cross sectional view of the middle sole taken along line IX—IX in FIG. 11.
Figure 10:
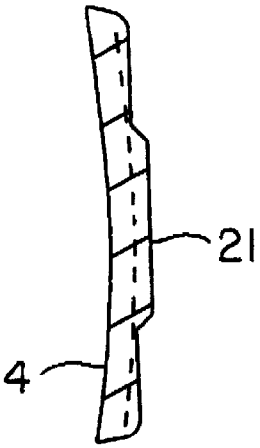
FIG. 10 is a cross sectional view of the middle sole taken along line X—X in FIG. 11.
Figure 11:
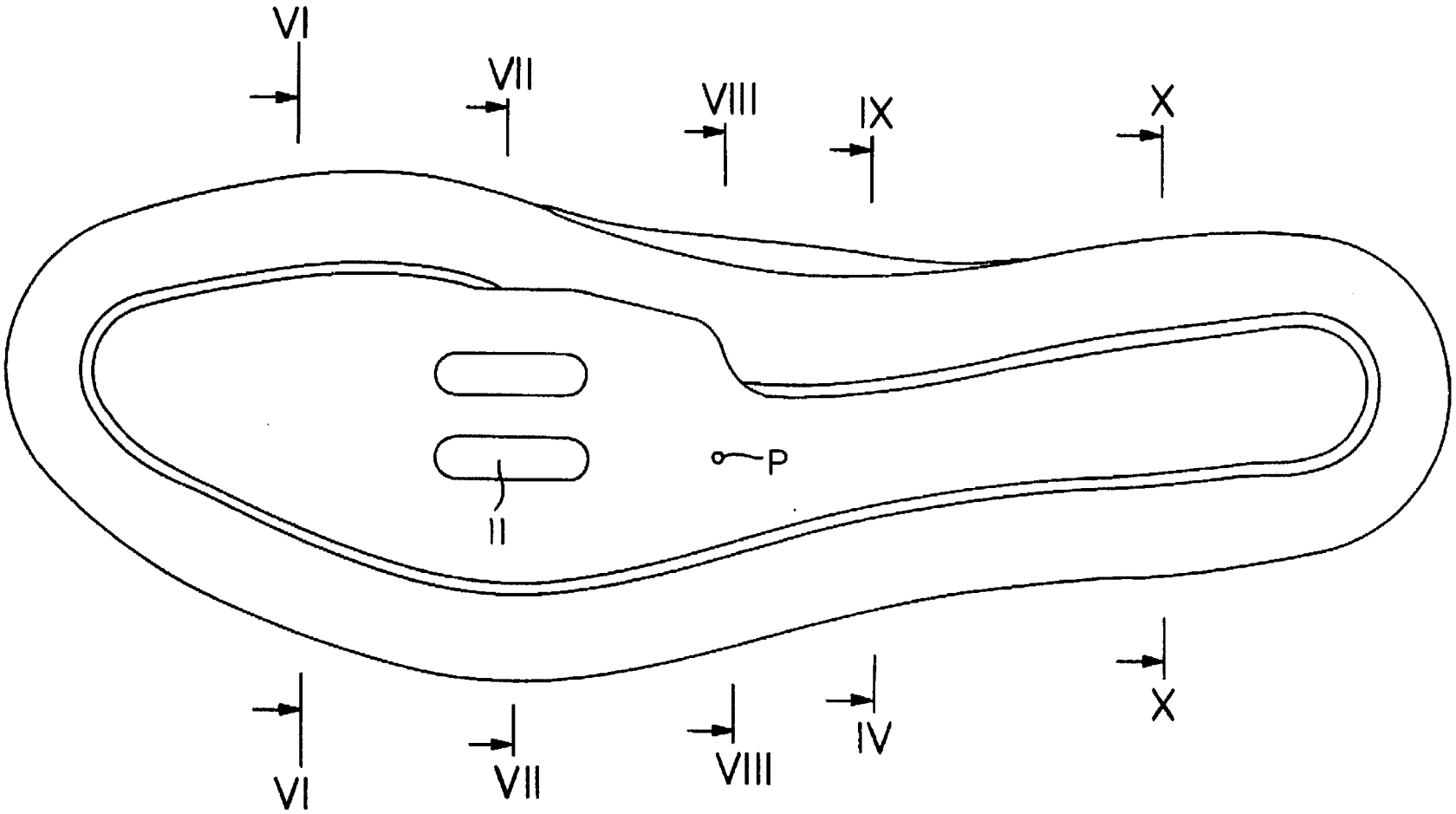
FIG. 11 is a bottom view of the middle sole used in the sandal shown in FIG. 1.

FIGS. 4–11 elaborate on the structure of the middle sole 4. FIG. 5 is a cross section taken along line V—V in FIG. 4. FIGS. 6–10 are cross sections taken along lines VI—VI, VII—VII, VIII—VIII, IX—IX, and X—X, respectively, in FIG. 11. As shown in FIG. 5, the middle sole 4 has maximum thickness in an area near the point of inflection P (or near a horizontal line containing the point of inflection P). As shown in FIGS. 6 and 7, the middle sole 4 has maximum width in the front portion (in the portion closer to the toes and farther from the point of inflection P). As shown in FIGS. 9 and 10, the middle sole 4 has minimum width in the back portion (in the portion closer to the heel and farther from the point of inflection P).

The middle sole 4 is concave overall. Specifically, the left and right sides are raised as shown in FIGS. 6 through 10. The cleat attachment holes 11 for cleat coupling are provided at the position of maximum width. The middle sole is thicker in a linear region 21 extending in the longitudinal direction on the underside of the central region than on the left or right sides thereof. In the longitudinal region near the point of inflection P, the middle sole 4 is thinner on the inside (on the downside in FIG. 11) than on the outside.

To use the sandal, the cyclist inserts his or her foot into the sandal, and the free end of the releasable portion of the left toe-securing band 2bL is passed through the toe-coupling means 7 and folded back. The left toe-securing band 2bL and the right toe-securing band 2bR can be joined and tightened by aligning the hook and loop fasteners on the facing sides of the folded left toe-securing band 2bL. The degree of tension can be adjusted by varying the folding position. The free end of the releasable portion of the left heel-securing band 2aL is then passed through the heel-coupling means 6 and folded back. The left heel-securing band 2aL and right heel-securing band 2aR can be joined and tightened by aligning the fasteners on the facing sides of the folded left heel-securing band 2aL. The degree of tension can be adjusted by varying the folding position. Adjusting the degree of tension in such a manner allows the heel-securing band 2a and the toe-securing band 2b to snugly secure the toe area and the heel area of the foot against the sole 1.

After the sandals are secured to the cyclist's foot, the cyclist inserts the cleats 3 into the bicycle pedals at predetermined positions. The pedaling force acts to further bend the sole 1 around the point of inflection, but the magnitude of this force varies periodically from high to low, and the fact that the middle sole 4 is hard and hence rigid allows the sole to rapidly regain its original shape as soon as the pedaling force decreases. Such a bending force also acts to bend the middle sole 4 and to stretch the connecting band 2c, but the deformation of the middle sole 4 is suppressed by the tension of the connecting band 2c, which is made of a material that is hard to stretch. As noted above when discussing the structures shown in FIGS. 6 through 10, the central portion is thicker than the left or right side, and thus generally functions as a stiff structural member while preserving its elasticity. Resistance to bending is also high because of the considerable thickness of the central bending portion. Thus, the cleated sandal of this invention has only minor energy losses because it is rigid and easily restores its original state. The cleat, which does not extend below the lower-end surface of the sole 1, does not impede walking when the rider gets off the bicycle and walks. Thus, the sandal can be used for both cycling and walking. Because the sandals have good ventilation, they can be used as sporting footwear, and particularly sporting footwear for summer use. The degree of tension is easy to adjust, and the range of cleat adjustment angles is large.

While the above is a description of various embodiments of the present invention, further modifications may be employed without departing from the spirit and scope of the present invention. Thus, the scope of the invention should not be limited by the specific structures disclosed. Instead, the true scope of the invention should be determined by the following claims. Of course, although labeling symbols are used in the claims in order to facilitate reference to the figures, the present invention is not intended to be limited to the constructions in the appended figures by such labeling.

What is claimed is:

1. A sandal comprising:

a sole (1);

a strap (2) connected to the sole (1), wherein the strap (2) defines a rear side open space between a heel portion of the strap (2*a*) and a heel portion of the sole, wherein the strap (2) defines a lateral side open space between a side portion of the strap (2*c*) and a side portion of the sole, and wherein the strap (2) defines a front side open space between a toe portion of the strap (2*b*) and a toe portion of the sole; and wherein the sole (1) includes:

a rigid middle sole (4) that extends along substantially an entire longitudinal length of the sole (1);

a flexible first covering sole (5) disposed on a lower surface of the middle sole (4), wherein the covering sole (5) includes a window (12) for exposing a portion of the middle sole (4); and first and second cleat attachment holes (11) disposed in the window (12) for fixing a cleat (3) to a bottom surface of the sole (1).

2. The sandal according to claim 1 wherein the first and second cleat attachment holes (11) are disposed in front of a center portion of the sole (1).

3. The sandal according to claim 2 wherein the first and second cleat attachment holes (11) are arranged in a row in a lateral direction of the sole.

4. The sandal according to claim 3 wherein the first and second cleat attachment holes (11) are spaced apart by not more than 14 mm.

5. The sandal according to claim 3 wherein a distance between a front end of the sole (1) and a longitudinal center point of the first and second cleat attachment holes (11) is set at approximately 25% to 45% of a distance between the front end of the sole (1) and a rear end of the sole (1), and wherein a distance between the first and second cleat attachment holes (11) is not greater than 25% of a width of the sole (1) at the location of the first and second cleat attachment holes (11).

6. The sandal according to claim 1 wherein the first and second cleat attachment holes (11) are elongated in a longitudinal direction of the sole (1).

7. The sandal according to claim 1 wherein the strap (2) includes:

a rear strap (2*a*) disposed at a rear portion of the sandal;

a front strap (2*b*) disposed at a from portion of the sandal; and a connecting band (2*c*) connected to the rear strap (2*a*) and to the front strap (2*b*).

8. The sandal according to claim 7 wherein the front strap (2*b*) includes:

a left from strap (2*b*L) coupled to a left side of the sandal;

a fight front strap (2*b*R) coupled to a right side of the sandal; and wherein the left from strap (2*b*L) and the right front strap (2*b*R) are structured to be selectively connected to and disconnected from each other.

9. The sandal according to claim 8 wherein the rear strap (2*a*) includes:

a left rear strap (2*a*L) coupled to a left side of the sandal;

a right rear strap (2*a*R) coupled to a right side of the sandal; and wherein the left rear strap (2*a*L) and the fight rear strap (2*a*R) are structured to be selectively connected to and disconnected from each other.

10. The sandal according to claim 1 wherein the middle sole (4) has an upwardly facing concave front portion.

11. The sandal according to claim 1 wherein the middle sole (4) has a downwardly facing concave rear portion.

12. The sandal according to claim 1 further comprising a second coveting sole (5) disposed on an upper surface of the middle sole (4).

13. The sandal according to claim 11 wherein the middle sole (4) includes an inflection point (P).

14. The sandal according to claim 13 wherein the inflection point (P) is located behind the first and second cleat attachment holes (11).

15. The sandal according to claim 13 wherein the middle sole (4) has an upwardly facing concave front portion and a downwardly facing concave rear portion.

16. The sandal according to claim 15 wherein the inflection point (P) is located behind the first and second cleat attachment holes (11).

17. The sandal according to claim 16 further comprising a second covering sole (5) disposed on an upper surface of the middle sole (4).

18. A sandal comprising:

a sole (1);

a strap (2) connected to the sole (1), the strap including:

a rear strap (2*a*) disposed at a rear portion of the sandal and defining an open space between the rear strap (2*a*) and the sole (1);

a front strap (2*b*) disposed at a front portion of the sandal and defining an open space between the front strap (2*a*) and the sole (1); and a connecting band (2*c*) connected to the rear strap (2*a*) and to the front strap (2*b*), the connecting band defining an open space between the connecting band (2*c*) and the sole (1);

wherein the sole (1) includes:

a rigid middle sole (4) that extends along substantially an entire longitudinal length of the sole (1);

a flexible first coveting sole (5) disposed on a lower surface of the middle (4), wherein the coveting sole (5) includes a window (12) for exposing a portion of the middle sole (4); and at least two elongated cleat attachment holes (11) for fixing a cleat (3) on a bottom surface thereof.

19. The sandal according to claim 18 wherein the front strap (2*b*) includes:

a left front strap (2*b*L) coupled to a left side of the sandal and defining an open space between the left from strap (2*b*L) and the sole (1);

a right front strap (2*b*R) coupled to a right side of the sandal and defining an open space between the right front strap (2*b*R) and the sole (1); and wherein the left front strap (2*b*L) and the right front strap (2*b*R) are structured to be selectively connected to and disconnected from each other.

20. The sandal according to claim 19 wherein the rear strap (2*a*) includes:

a left rear strap (2*a*L) coupled to a left side of the sandal and defining an open space between the left rear strap (2*a*L) and the sole (1);

a right rear strap (2*a*R) coupled to a fight side of the sandal and defining an open space between the right rear strap (2*a*R) and the sole (1); and wherein the left rear strap (2*a*L) and the fight rear strap (2*a*R) are structured to be selectively connected to and disconnected from each other.

21. The sandal according to claim 18 wherein the middle sole (4) has an upwardly facing concave front portion.

22. The sandal according to claim 18 wherein the middle sole (4) has a downwardly facing concave rear portion.

23. The sandal according to claim 18 further comprising a second covering sole (5) disposed on an upper surface of the middle sole (4).

24. The sandal according to claim 18 wherein the middle sole (4) includes an inflection point (P).

25. The sandal according to claim 24 wherein the inflection point (P) is located behind the first and second cleat attachment holes (11).

26. The sandal according to claim 24 wherein the middle sole (4) has an upwardly facing concave front portion and a downwardly facing concave rear portion.

27. The sandal according to claim 26 wherein the inflection point (P) is located behind the first and second cleat attachment holes (11).

28. The sandal according to claim 27 further comprising a second covering sole (5) disposed on an upper surface of the middle sole (4).

* * * * *